United States Patent [19]

Straw

[11] 4,244,840

[45] Jan. 13, 1981

[54] SELF-OPACIFIED LIQUID HARD SURFACE CLEANING COMPOSITIONS

[75] Inventor: Alan Straw, Macclesfield, England

[73] Assignee: Colgate-Palmolive Company, New York, N.Y.

[21] Appl. No.: 902,142

[22] Filed: May 2, 1978

[30] Foreign Application Priority Data

May 10, 1977 [GB] United Kingdom ..... 19559/77

[51] Int. Cl.[3] ..... C11D 1/22; C11D 1/83; C11D 3/065

[52] U.S. Cl. ..... 252/540; 252/550; 252/551; 252/554; 252/555; 252/558; 252/559; 252/531; 252/532; 252/535; 252/536; 252/539; 252/DIG. 14

[58] Field of Search ..... 252/531, 550, 532, 551, 252/533, 553, 535, 554, 536, 555, 538, 557, 539, 558, 540, 559, DIG. 14

[56] References Cited

U.S. PATENT DOCUMENTS

| | | | |
|---|---|---|---|
| 2,913,416 | 11/1959 | Fineman et al. | 252/109 |
| 2,979,466 | 4/1961 | Silberman | 252/540 |
| 2,992,993 | 7/1961 | Pengilly | 252/139 |
| 3,075,922 | 1/1963 | Wixon | 252/539 |
| 3,192,166 | 6/1965 | Smith | 252/539 X |
| 3,558,495 | 1/1971 | Mace | 252/90 |
| 3,634,268 | 1/1972 | Karg | 252/529 |
| 3,738,943 | 6/1973 | Kaneko | 252/540 |
| 3,935,129 | 1/1976 | Jabalee | 252/525 |
| 4,082,684 | 4/1978 | Kreischer | 252/109 |

FOREIGN PATENT DOCUMENTS

| | | | |
|---|---|---|---|
| 2050641 | 4/1971 | France . | |
| 945333 | 12/1963 | United Kingdom | 252/529 |

*Primary Examiner*—P. E. Willis, Jr.
*Attorney, Agent, or Firm*—Richard N. Miller; Murray M. Grill; Herbert S. Sylvester

[57] ABSTRACT

A liquid hard surface cleaner is disclosed that is impalpable, self-opacifying, enjoys low temperature stability and has satisfactory viscosity and detergency, these being achieved by a particular combination of ingredients and proportions; namely, the composition comprising, by weight, a water-soluble, synthetic, anionic, sulphated or sulphonated detergent salt containing an alkyl radical of 8 to 22 carbon atoms in the molecule, a water-soluble alkylene oxylated nonionic detergent, a water-soluble detergent builder salt and the balance water, the weight ratio of anionic detergent to nonionic detergent being from 0:5 to 6:1 and the weight ratio of builder salt to total detergent being in the range of 1:5 to 5:1.

10 Claims, No Drawings

SELF-OPACIFIED LIQUID HARD SURFACE CLEANING COMPOSITIONS

This invention relates to liquid cleaning compositions suitable for cleaning hard surfaces, hereinafter referred to as liquid hard surface cleaners.

Liquid hard surface cleaners are generally classified into two types. The first type is a particulate aqueous suspension having water-insoluble abrasive particles suspended therein, which particles are palpable. Some of the cleaners of this type suffer a stability problem. Other cleaners of this type have received poor acceptance by consumers because of their "gritty" feel which causes many people to be reluctant to use them for fear of scratching the surface to be cleaned, and because of the stability problem. The second type is the so-called all purpose liquid detergent which generally is preferred by consumers and often are based upon soap, fatty alkanolamide and alkyl benzene sulphonate. While such compositions have a satisfactory viscosity they lack the cleansing power of soap-amide-alkyl benzene sulphonate-ethoxylated alcohol compositions. The latter compositions, however, generally have a low content of alkyl benzene sulphonate and a high level of ethoxylated alcohol and, therefore, require a high content of a hydrotrope for stability and also require the presence of an opacifier ingredient in order to achieve the opacified product which is so popular with consumers. While the inclusion of the hydrotrope improves the stability it lowers the viscosity.

The invention can provide a liquid hard surface cleaner that is impalpable, self-opacifying, enjoys low temperature stability and has satisfactory viscosity and detergency. The term "self-opacifying" as used herein refers to the cleaner having inherent opacity without the need for the addition of an opacifying agent. The self-opacifying quality affords the two-fold advantage of a cost saving in not having to add an opacifier, and a reduction in the susceptibility of the composition to cream which may occur if a polymeric opacifier, e.g., a polystyrene emulsifier is present.

Liquid cleaners embodying the present invention have also been found to exhibit effective grease soil removal, effective lathering and removal of soils from glass, woodwork, vitreous, painted and enamelled surfaces, and from metal surfaces such as aluminium ware and copper pan bottoms, with effective polishing action and no scratching. The cleaners are also effective for removing soil from the hands and from vehicle tires, for removal of wax from waxed surfaces, and for a variety of other applications.

The cleaners of the present invention can be formulated to exhibit desirable characteristics with regard to both physical properties and performance in use. As to physical properties, the compositions may be formulated to be homogeneous, pourable and free-flowing from the container as manufactured as well as after aging. They may be formulated to exhibit a high degree of stability upon storage at normal room temperature of about 70° F. over a period of many months without any appreciable precipitation or formation of layers. When subjected to elevated temperatures of about 100° F. or cooled to about 40° F. the liquid may remain in homogeneous form. As a result of this homogeneity, even when only very small quantities are dispensed the components will be present in the correct proportions. The liquid may be packaged in any suitable container such as metal, plastic or glass bottles, bags, cans or drums.

According to the present invention a liquid hard surface cleaner comprises, by weight, from 2 to 6% of a water-soluble synthetic anionic detergent, from 1 to 4% of water-soluble alkyleneoxylated $C_8$–$C_{18}$ alcohol detergent, from 2 to 15% of water-soluble builder salt, as optional ingredients up to 2% $C_8$–$C_{18}$ fatty acid, up to 8% urea and up to a total of 5% of other additives, the balance being water.

Synthetic anionic detergents (excluding true soaps) employed in the cleaners can be broadly described as water-soluble salts, particularly alkali metal salts, of organic sulphuric reaction products having in the molecular structure an alkyl radical containing from 8 to 22 carbon atoms and a water-solubilizing radical selected from sulphonic acid or sulphuric acid ester radicals, and mixtures thereof. Illustrative examples of water-soluble synthetic anionic detergents are sodium and potassium alkyl sulphates, especially those obtained by sulphating the $C_8$–$C_{18}$ alcohols produced by reducing the glycerides of tallow or coconut oil; sodium and potassium alkyl benzene sulphonates in which the alkyl group contains from 9 to 15 carbon atoms, especially those of the type described in U.S. Pat. No. 2,220,099 and No. 2,477,383; sodium alkyl glyceryl ether sulphates, especially those ethers of the $C_8$–$C_{18}$ alcohols derived from tallow and coconut oil; sodium $C_8$–$C_{18}$ fatty acid monoglyceride sulphates; sodium and potassium salts of sulphuric acid esters of the reaction product of one mole of a $C_8$–$C_{18}$ fatty alcohol (e.g. tallow or coconut oil alcohols) and about one to five, preferably three moles of ethylene oxide; sodium and potassium salts of $C_8$–$C_{12}$ alkyl phenol ethylene oxide ether sulphate with about one to six units of ethylene oxide per molecule, such as ammonium nonyl phenol tetraethopomer sulphate; sodium and ammonium salts of $C_{10}$–$C_{20}$ alkane sulphonates; sodium salts of $C_{12}$–$C_{21}$ alkene sulphonates; the reaction product of $C_8$–$C_{18}$ fatty acids esterified with isethionic acid and neutralized with sodium hydroxide where, for example, the fatty acids are derived from coconut oil, and mixtures thereof; and others known in the art, a number being specifically set forth in U.S. Pat. Nos. 2,486,921; 2,486,922 and 2,396,278.

The most highly preferred water-soluble synthetic anionic detergents are the ammonium and substituted ammonium (such as mono, di and triethanolamine) alkali metal (such as sodium and potassium) and alkaline earth metal (such as magnesium) salts of $C_9$–$C_{15}$ alkyl benzene sulphonates and mixtures with $C_{12}$–$C_{21}$ olefin sulphonates and $C_8$–$C_{18}$ alkyl sulphates, and the $C_8$–$C_{18}$ fatty acid monoglyceride sulphates. The most preferred are higher alkyl aromatic sulphonates such as higher alkyl benzene sulphonates containing from 9 to 15 carbon atoms in the alkyl group in a straight or branched chain, e.g. sodium salts of higher alkyl benzene sulphonates or of higheralkyl toluene, xylene or phenol sulphonates. Mixed long chain alkyls derived from coconut oil fatty acids and the tallow fatty acids can also be used along with cracked paraffin wax olefins and polymers of lower monoolefins. In one type of cleaner composition there is used a linear alkyl benzene sulphate having a high content of 3 (or higher) phenyl isomers and a correspondingly low content (well below 50%) of 2 (or lower) phenyl isomers; in other terminology the benzene ring is preferably attached in large part at the 3 or higher (e.g. 4, 5, 6 or 7) position of the alkyl group and the contents of isomers at which the benzene ring is attached at the 2 or 1 position is correspondingly low. Mixtures of various cations can be used.

Nonionic detergents employed in the cleaners can be broadly described as water-soluble or water dispensible compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements; for example, the condensation product of aliphatic alcohols having from 8 to 22 carbon atoms, in either straight or branched chain configuration, with ethylene oxide, such as a coconut alcohol ethylene oxide condensate having from 2 to 15 moles of ethylene oxide per mole of coconut alcohol.

Suitable alcohols are those having a hydrophobic character, preferably having from 8 to 22 carbon atoms more preferably saturated fatty alcohols having 8 to 18 carbon atoms. Examples thereof are iso-octyl, nonyl, decyl, dodecyl, tridecyl, tetradecyl, hexadecyl, octadecyl and olcyl alchols which may be condensed with the appropriate amount of ethylene oxide, such as at least 2 moles, preferably 3 to 8, but up to about 15 moles. A typical product is tridecyl alcohol, produced by the oxo process, condensed with about 2, 3 or 6 moles of ethylene oxide. The corresponding higher alkyl mercaptan or thioalcohols condensed with ethylene oxide are also suitable for use in the compositions of the invention. Other suitable nonionic detergents are the condensates of $C_6$–$C_{12}$ alkyl phenol with 5 to 30 moles of ethylene oxide and condensates of $C_{10}$–$C_{16}$ alkanols with a heteric mixture of ethylene oxide and propylene oxide in a weight ratio of 2.5:1 to 4:1 with the total alkylene oxide content being 60–85% by weight.

A water-soluble builder salt is employed in the cleaner. A mixture of such salts also may be employed, and where so employed is generally of two distinct classes, e.g., an inorganic salt and an organic salt, for example, an alkali metal carbonate and an alkali metal salt of an organic acid. Suitable builder salts include the sodium, potassium and ammonium salts of ethylene diaminetraacetic acid and nitrilotriacetic acid, sodium and potassium tripolyphosphate, sodium and potassium acid pyrophosphates, sodium and potassium pyrophosphates, trisodium and tripotassium phosphates, and sodium and potassium phosphates. Inert inorganic salts, e.g., sodium and potassium chlorides and sulphates and ammonium sulphate and mixtures thereof, also may be present in the cleaners.

A $C_8$–$C_{18}$ fatty acid is an optional component and may be employed in amounts of up to 2%, preferably from 0.5 to 1% by weight.

Urea is another optional component and may be employed in amounts of up to 8% by weight, preferably from 2 to 4% where employed. Its use may be indicated by the anionic detergent employed. Urea improves low temperature stability and also increases the viscosity of the cleaner.

Further optional additives such as dyes, perfumes and germicides may also be included in the composition in conventional amounts, not exceeding 5% by weight in total.

The balance of the composition is water.

The amount of anionic detergent employed is from 2 to 6% by weight, preferably from 3 to 4%; while the amount of nonionic detergent is from 1 to 4%, preferably from 2 to 3%. The weight ratio of one to the other may vary from 0.5:1 to 6:1, preferably from 3:2 to 4:2, and more preferably is about 3.5:2.

The total builder is employed in an amount of from 2 to 15%, preferably from 4% to 10% by weight. Where two distinctly different classes of builder salt are employed, the weight ratio of one to the other may be from 10:1 to 1:10, preferably from 3:1 to 1:3. The weight ratio of builder to anionic detergent is preferably in the range from 1:3 to 3:1 more preferably about 2:1. The ratio of builder to nonionic detergent is in the range from 15:1 to 1:2 preferably from 6:1 to 2:1. Expressed differently, the weight ratio of builder salt to total detergent is in the range from 1:5 to 5:1, and is preferably in the range from 1:2 to 2:1. Urea, when present has a weight ratio relative to the sum of detergents and builder of up to 8:5 preferably from 2:1 to 2:6 relative to the anionic detergent; preferably from 4:1 to 2:4 relative to the nonionic detergent; and preferably 1.33:1 to 2:12 relative to the total detergent.

Where a concentrate is desired, for subsequent dilution, the active ingredients are employed in the following range of parts by weight.

| | | preferred range |
|---|---|---|
| anionic detergent | 4–12 | 6–8 |
| nonionic detergent | 2–8 | 4–6 |
| fatty acid | 0–4 | 1–2 |
| builder | 4–30 | 12–20 |
| urea | 0–16 | 4–8 |

Sufficient water may be added to the concentrate to dilute it to a concentration of from about 3% to about 10%, preferably about 6%, by weight. Of course, the aforementioned properties of the composition relate to the final composition and may not apply to the concentrate as such.

The compositions of the invention may be produced by any of the techniques commonly employed in the manufacture of detergent compositions.

The following Examples illustrate the invention. All percentages are by weight.

EXAMPLE 1

| | % |
|---|---|
| $C_9$—$C_{13}$ Alkyl benzene sulphonic acid, sodium salt (ABS) | 3.5 |
| $C_8$—$C_{10}$ Alcohol 5 moles ethylene oxide (EO) | 2.0 |
| Distilled palm oil fatty acid | 0.5 |
| Sodium carbonate | 5.0 |
| Trisodium nitrilotriacetate monohydrate | 2.4 |
| Urea | 4.0 |
| Water, perfume, etc. | to 100.0 |

EXAMPLES 2–4

Example 1 is repeated except that the ABS has alkyl chain lengths of $C_7$ to $C_{14}$, $C_{10}$ to $C_{12}$ and $C_{10}$ to $C_{14}$, respectively.

EXAMPLES 5–6

Example 1 is repeated except that coconut oil fatty acid and a mixture of palm kernel/coconut oil fatty acids are respectively substituted for the palm oil fatty acid.

EXAMPLE 9

Example 1 is repeated except that a $C_9$–$C_{13}$ alcohol 4 to 6 EO is substituted for the $C_8$–$C_{10}$ alcohol ethoxylate.

EXAMPLE 10

Example 1 is repeated except that potassium pyrophosphate is employed instead of the sodium carbonate and trisodium nitrilotriacetate builder mixture.

What I claim as my invention and desire to secure by Letters Patent of the United States is:

1. A self-opacified, impalpable, homogeneous, liquid, hard surface cleaner consisting essentially of, by weight, from 2% to 6% of a water-soluble, synthetic, anionic, sulfated or sulfonated detergent salt containing an alkyl radical of 8 to 22 carbon atoms in the molecule, said salt being selected from the group consisting of ammonium, mono-, di- and triethanolammonium and alkali metal salts; from 1% to 4% of a water-soluble alkyleneoxylated nonionic detergent selected from the group consisting of condensates of $C_8$–$C_{18}$ alkanol with 2–15 moles of ethylene oxide, condensates of $C_6$–$C_{12}$ alkylphenol with 5 to 30 moles of ethylene oxide and condensates of $C_{10}$–$C_{16}$ alkanol with a heteric mixture of ethylene oxide and propylene oxide in a weight ratio of 2.5:1 to 4:1 with the total alkylene oxide content being 60% to 85% by weight, the weight ratio of anionic detergent to nonionic detergent being from 0.5:1 to 6:1; 2% to 15% of a water-soluble detergent builder salt, the weight ratio of builder salt to total detergent being in the range of 1:5 to 5:1; 0–2% of $C_8$–$C_{18}$ fatty acid, 0–8% of urea; and the balance water.

2. A cleaner as claimed in claim 1 wherein the anionic detergent salt is an alkali metal salt.

3. A cleaner as claimed in claim 2 wherein the anionic detergent is sodium $C_9$–$C_{15}$ alkyl benzene sulphonate.

4. A cleaner as claimed in claim 2 wherein the builder is a sodium or potassium inorganic phosphate salt.

5. A cleaner as claimed in claim 1 wherein said fatty acid is present and is a $C_8$–$C_{18}$ saturated fatty acid.

6. A cleaner as claimed in claim 1 wherein the builder is a 10:1 to 1:10 mixture by weight, of two different non-phosphate alkali metal builder salts.

7. A cleaner as claimed in claim 1 wherein the ratio by weight of anionic detergent to nonionic detergent is in the range from 3:2 to 4:2.

8. A cleaner as claimed in claim 1 wherein the ratio by weight of builder to total detergents is in the range from 1:2 to 2:1.

9. A cleaner as claimed in claim 1 wherein said urea is present and the weight ratio of urea to the sum of detergents and builder is up to 8:5.

10. A cleaner as claimed in claim 9 wherein said urea is present in an amount of 2% to 4% by weight, said $C_8$–$C_{18}$ fatty acid is present in an amount of 0.5% to 1% by weight, the weight ratio of anionic detergent to nonionic detergent is from 3:2 to 4:2 and the weight ratio of builder salt to total detergent is in the range of 1:2 to 2:1.

* * * * *